US009831569B2

(12) United States Patent
Hoppmann et al.

(10) Patent No.: US 9,831,569 B2
(45) Date of Patent: Nov. 28, 2017

(54) METAL PROTECTIVE CONDUCTOR CONNECTION ELEMENT AND ELECTRICAL SERIES TERMINAL

(71) Applicant: PHOENIX CONTACT GMBH & CO. KG, Blomberg (DE)

(72) Inventors: Ralph Hoppmann, Bad Oeynhausrn (DE); Kevin Berghahn, Istrup (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 15/104,989

(22) PCT Filed: Nov. 10, 2014

(86) PCT No.: PCT/EP2014/074148

§ 371 (c)(1),
(2) Date: Jun. 16, 2016

(87) PCT Pub. No.: WO2015/090729

PCT Pub. Date: Jun. 25, 2015

(65) Prior Publication Data

US 2016/0322718 A1 Nov. 3, 2016

(30) Foreign Application Priority Data

Dec. 18, 2013 (DE) ..... 10 2013 114 315

(51) Int. Cl.
*H01R 9/26* (2006.01)

(52) U.S. Cl.
CPC ..... *H01R 9/26* (2013.01); *H01R 9/2691* (2013.01)

(58) Field of Classification Search
CPC ..... H01R 9/26; H01R 9/2608
(Continued)

(56) References Cited

U.S. PATENT DOCUMENTS 3,135,572 A * 6/1964 Curtis ..... H01R 9/26 439/716
3,277,427 A * 10/1966 Jurca ..... H01R 9/26 439/716

(Continued)

FOREIGN PATENT DOCUMENTS

DE 29821558 U1 3/1999
DE 10324144 B4 9/2005

(Continued)

*Primary Examiner* — Gary Paumen
(74) *Attorney, Agent, or Firm* — Leydig, Voit & Mayer, Ltd.

(57) ABSTRACT

A metal protective conductor connection element has a metal foot arrangement which has at least one first metal foot and at least one second metal foot for supporting on a support rail. The first metal foot has a first spring element with a contact region for forming a force-fitting connection of the first spring element of the first metal foot to the support rail and a second spring element with a securing region for forming a form-fitting connection of the second spring element of the first metal foot to the support rail. The second metal foot has a first spring element with a securing region for forming a form-fitting connection of the first spring element of the second metal foot to the support rail and a second spring element for forming a form-fitting connection of the second spring element of the second metal foot to the support rail.

13 Claims, 4 Drawing Sheets

(58) Field of Classification Search
USPC ..... 439/716, 532
See application file for complete search history.

(56) References Cited

U.S. PATENT DOCUMENTS

| | | | | | |
|---|---|---|---|---|---|
| 4,729,064 | A * | 3/1988 | Singer, Jr. | H04Q 1/149 | 361/119 |
| 5,022,873 | A * | 6/1991 | Kollmann | H01R 9/2691 | 439/716 |
| 5,362,259 | A * | 11/1994 | Bolliger | H01R 9/2691 | 439/532 |
| 5,480,310 | A * | 1/1996 | Baum | H01R 9/2691 | 439/716 |
| 2001/0051466 | A1 * | 12/2001 | Bechaz | H01R 9/2691 | 439/716 |

FOREIGN PATENT DOCUMENTS

| | | | |
|---|---|---|---|
| EP | 0233458 | A1 | 8/1987 |
| EP | 1182735 | A2 | 2/2002 |
| EP | 1860738 | A1 | 11/2007 |

* cited by examiner

METAL PROTECTIVE CONDUCTOR CONNECTION ELEMENT AND ELECTRICAL SERIES TERMINAL

CROSS-REFERENCE TO RELATED APPLICATIONS

This application is a U.S. national stage application under 35 U.S.C. §371 of International Application No. PCT/EP2014/074148, filed on Nov. 10, 2014, and claims benefit to German Patent Application No. DE 10 2013 114 315.6, filed on Dec. 18, 2013. The International Application was published in German on Jun. 25, 2015, as WO 2015/090729 A1 under PCT Article 21(2).

FIELD

The invention relates to a metal protective conductor connection element for arrangement on an electrical series terminal which has a terminal housing. Furthermore, the invention relates to an electrical series terminal, in particular a protective conductor terminal, having such a metal protective conductor connection element for placement on a mounting rail.

BACKGROUND

A metal protective conductor connection element for arrangement on a series terminal is known from DE 103 24 144 B4, which element has a plurality of disc-shaped metal feet connected to one another. At least one latch for fixing the protective conductor connection element to at least one latch opening in a side wall of the terminal housing is formed on each of the metal feet. Furthermore, the metal feet each have two hook and spring devices, by means of which the protective conductor connection element can be snapped onto a mounting rail in that the protective conductor connection element is latched to the mounting rail at all connection points so as to form a positive connection with the mounting rail. Moreover, the hook and spring devices are formed such that all of the metal feet of a protective conductor connection element can latch onto one foot element of the terminal housing. A handling socket is formed on the foot element, into which a release tool, for example the tip of a screwdriver, can be inserted, in order to tilt the foot element and thus also the hook and spring devices of the metal feet that are hooked into the foot element such that the entire series terminal can be removed from the mounting rail. This is disadvantageous in that high forces have to be applied by means of the release tool in order to unlatch the series terminal, in particular the protective conductor connection element, from the mounting rail in this way, as a result of which handling is made more difficult for a user.

SUMMARY

An aspect of the invention provides a metal protective conductor connection element for arrangement on an electrical series terminal having a terminal housing. The connection element includes: a metal foot arrangement including a first metal foot configured to rest on a mounting rail and a second metal foot configured to rest on the mounting rail. The first metal foot includes a first spring element including a contact region configured to non-positively connect the first spring element of the first metal foot to the mounting rail, wherein the first metal foot includes a second spring element including a securing region configured to positively connect the second spring element of the first metal foot to the mounting rail. The second metal foot includes a further first spring element including a securing region configured to positively connect the further first spring element to the mounting rail, and wherein the second metal foot includes a further second spring element configured to positively connect the further second spring element to the mounting rail.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
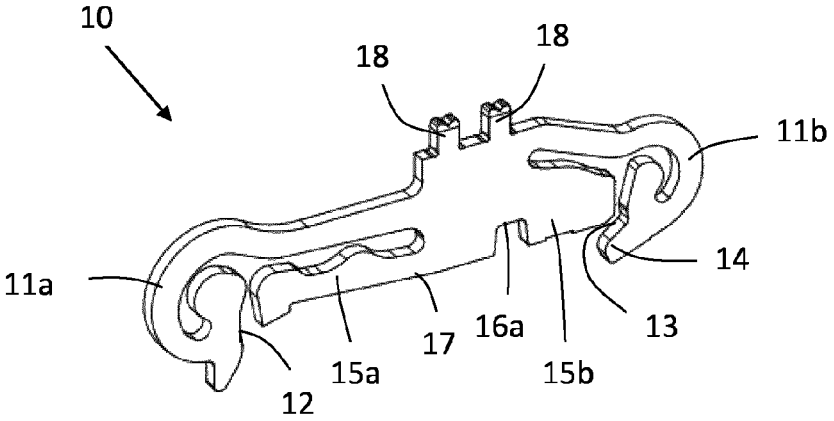
FIG. 1 is a schematic view of a first metal foot of a metal foot arrangement of a metal protective conductor connection element according to the invention.

An aspect of the invention provides a metal protective conductor connection element and an electrical series terminal, in which the forces required for unlatching the series terminal and the metal protective conductor connection element from a mounting rail can be reduced without influencing the current load capacity.

According to an aspect of the invention, a metal protective conductor connection element for arrangement on an electrical series terminal which has a terminal housing, comprises a metal foot arrangement which has at least one first metal foot for resting on a mounting rail and at least one second metal foot for resting on the mounting rail, the first metal foot having a first spring element comprising a contact region for non-positively connecting the first spring element of the first metal foot to the mounting rail, and a second spring element comprising a securing region for positively connecting the second spring element of the first metal foot to the mounting rail, and the second metal foot having a first spring element comprising a securing region for positively connecting the first spring element of the second metal foot to the mounting rail, and a second spring element for positively connecting the second spring element of the second metal foot to the mounting rail.

The protective conductor connection element is characterized in particular in that it has two different kinds of metal feet, it being possible for one or more metal feet of the two kinds of metal feet to be provided on each protective conductor connection element. These two kinds of metal feet, the first kind of metal foot being formed by the first metal foot and the second kind of metal foot being formed by the second metal foot, differ from one another in that only one of the two metal feet, specifically the second metal foot, latches onto the mounting rail with its two spring elements in a positive connection in the mounted state, whereas the other metal foot, specifically the first metal foot, only latches onto the mounting rail with one of its two spring elements in a positive connection in the mounted state and the other of the two spring elements simply rests on the mounting rail by means of a non-positive connection and therefore does not actually latch onto the mounting rail. The spring elements of the first metal foot are thus designed according to the invention such that the first spring element has a contact region for the first spring element to rest in a non-positive manner on the mounting rail and the second spring element has a securing region, in particular a latching region, for the second spring element to be secured in a positive manner to the mounting rail. The first metal foot thus simply rests on the mounting rail by the contact region of the first spring element and is thus preferably not secured to the mounting rail by means of hooking behind or latching onto the mounting rail, for example. When unlatching the series terminal and the protective conductor connection element from the mounting rail, no force therefore has to be applied in the region of the first spring element of the first metal foot in order to release the first spring element from the mounting rail. The unlatching force to be applied to the entire series terminal and the entire protective conductor connection element can therefore be reduced. By contrast, the first metal foot is preferably secured to the mounting rail by means of the securing region of the second spring element in a positive manner by hooking behind or latching onto said rail. In the case of the second metal foot, both spring elements each have a securing region, in particular a latching region, by means of which the second metal foot is secured in a positive manner to the mounting rail in the mounted state. It is preferably provided such that the securing regions of the second spring elements of the first and of the second metal foot have a similar or even identical design, whereas the first spring elements of the first and of the second metal foot differ from one another substantially since only the first spring element of the second metal foot can be secured to the mounting rail in a positive manner, and the first spring element of the first metal foot merely rests on the mounting rail in the mounted state and is not secured thereto in a positive manner. As a result of the first spring element of the first metal foot merely resting on the mounting rail in the mounted state and not being fitted in a positive manner thereto, the forces required for unlatching the protective conductor connection element and the series terminal from the mounting rail can be reduced substantially. The contact region for forming a non-positive connection to the mounting rail can, for example, be formed by a rounded surface on the first spring element of the first metal foot. The securing regions for forming a positive connection to the mounting rail in contrast preferably have a latching surface, for example a latch, which can hook on behind the mounting rail in order to be able to form the positive connection. As a result of the first metal foot resting on the mounting rail when the series terminal and therefore the protective conductor connection element are mounted, even if said foot is not latched onto the mounting rail by means of one of the two spring elements, the one or more first metal feet form an electrical contact between the series terminal, in particular the busbar of the series terminal, and the mounting rail such that, despite a reduction in the unlatching forces, on account of which the unlatching force to be applied can be reduced for the first metal foot or feet by designing one of the two spring elements having a contact region, the quality of the electrical contact is not reduced and thus the current load capacity of the protective conductor connection element is not influenced, in particular is not reduced. In particular, in the case of large conductor cross sections, a good current load capacity can therefore be achieved using the protective conductor connection element, despite a reduction in the unlatching forces to be applied.

According to a preferred embodiment, the second metal foot has a latch element for latching onto a foot element of the terminal housing, such that when the metal protective conductor connection element is mounted on the series terminal, only the second metal foot of the metal foot arrangement is latched into the foot element of the terminal housing. It is therefore preferably provided for just one kind of metal foot, specifically the second metal foot, to have a latch element, by means of which this second metal foot can be latched into the foot element of the terminal housing. The other kind of metal foot, specifically the first metal foot, in contrast preferably does not comprise a latch element and can therefore not be latched into the foot element of the terminal housing either. Both kinds of metal feet act as the electrical contact of the series terminal to the mounting rail, but preferably only the second metal foot and therefore not the first metal foot additionally acts to securely secure the protective conductor connection element to the foot element of the terminal housing of the series terminal. The protective conductor connection element is therefore preferably formed from a combination of metal feet which either latch or do not latch onto the foot element of the terminal housing. As a result of this, when the protective conductor connection element and the series terminal is unlatched from the mounting rail, only the one or more second metal feet of the metal foot arrangement, which have a corresponding latch element for latching onto the foot element of the terminal housing, also have to be tilted such that the force to be applied for unlatching is determined solely by the second metal feet of the metal foot arrangement, and therefore the force to be applied overall for unlatching can be reduced even for a larger number of metal feet, in particular a larger number of first metal feet, in a metal foot arrangement. In the process, the force required for unlatching can be reduced such that a sufficiently high contact force towards the mounting rail is still formed despite the reduction, and such that the latch element formed as the link between a release tool, such as a screwdriver, and the protective conductor connection element is not destroyed, in particular during an unlatching procedure. The latch element can, for example, be in the form of a hook.

The metal foot arrangement can have one or more first metal feet and one or more second metal feet. It is preferably provided for the metal foot arrangement to have two second metal feet and at least one first metal foot, the at least one first metal foot preferably being arranged between the two second metal feet. The second metal feet, which each have one latch element, are therefore preferably arranged on the outsides of a metal foot arrangement, the first metal feet, which have no latch element, preferably being arranged in an inside region of the metal foot arrangement. As a result of this, unintentional releasing of the first metal foot from the metal foot arrangement can be prevented since the first metal foot, which does not latch into the foot element of the terminal housing in the mounted state, is securely clamped between two second metal feet by means of latching.

Other sequences of arrangements of the metal feet in a metal foot arrangement are, however, also feasible, for example that one or more second metal feet are also arranged between two or more second metal feet.

In order to facilitate mounting of the protective conductor connection element, it is preferably provided for the first metal foot and the second metal foot to have at least one assembly coding. The assembly coding allows the metal feet to be handled without great effort in a mounting device. In particular, targeted control of the sequence of the first and second metal feet for forming the metal foot arrangement can be enabled as a result. Furthermore, with such an assembly coding, it is also possible to select the metal feet arranged in the metal foot arrangement in a targeted manner depending on the design of the busbar used in the series terminal. The assembly coding thus allows for a reduction in the risk of mistaking the metal feet to be arranged and those to be used inside a metal foot arrangement.

The assembly coding can be formed on an outer circumferential surface of the first metal foot and/or on an outer circumferential surface of the second metal foot. By forming the assembly coding on an outer circumferential surface of the metal feet, the handling of the assembly coding and therefore of the metal feet in a mounting device can be facilitated, it thus being possible in particular to facilitate insertion of the metal feet into the mounting device, depending on the assembly coding. It is, however, also possible for the assembly coding to be formed on the inside of the first metal foot and/or on the second metal foot.

It is preferably provided for a first assembly coding to be formed on a bottom side of the first metal foot, which side points towards the mounting rail when the metal protective conductor connection element is mounted on the mounting rail, and/or on a bottom side of the second metal foot, which side points towards the mounting rail when the metal protective conductor connection element is mounted on the mounting rail. If an assembly coding is formed on a bottom side of a metal foot, this can interact with a counter coding, which is formed on the terminal housing of the series terminal, as a result of which it can be ensured that the metal feet are joined together, in particular blocked, in the desired combination in order to form a metal foot arrangement.

This first assembly coding can, for example, be in the form of a recess. A counter-coding formed on the terminal housing can hook into a first assembly coding designed as a recess. The shape or contour of the first assembly coding, which is designed as a recess, can be extended in any manner and as required starting from a common basic design. The basic design of the recess can, for example, be U- or V-shaped.

A second assembly coding can, for example, be formed on the latch element of the first spring element of the second metal foot. By forming this second assembly coding on the latch element of the first spring element of the second metal foot, said second coding can interact with a counter-coding formed in the foot element of the terminal housing of the series terminal.

The second assembly coding can, for example, be in the form of a hook, which can then, for example, hook into a counter-coding, which is designed as a recess, on the foot element of the terminal housing. The counter-coding designed as a recess can, for example, be a receiving space in the foot element of the terminal housing, into which the latch element of the second metal foot can also hook.

In order to secure the metal foot arrangement to a busbar arranged inside the terminal housing, the first metal foot and/or the second metal foot can have at least one securing means. The securing means are preferably adjusted to the thickness of the busbar, it being possible, for example, for the adjustment to be made by specifically selecting the length of the securing means. For example, the securing means can be designed as studs, which can be riveted to the busbar, or as latches, which can latch into the openings on the busbar. The securing means are preferably integral with the particular metal foot.

In an embodiment, the present invention provides an electrical series terminal, in particular a protective conductor terminal, for placement on a mounting rail comprising a terminal housing made of an insulating material, at least two conductor connection elements, at least one busbar which electrically connects the conductor connection elements and is arranged inside the terminal housing, and one metal protective conductor connection element, as designed and developed above, acting as an electrically conductive connection between the busbar and the mounting rail.

Figure 6:
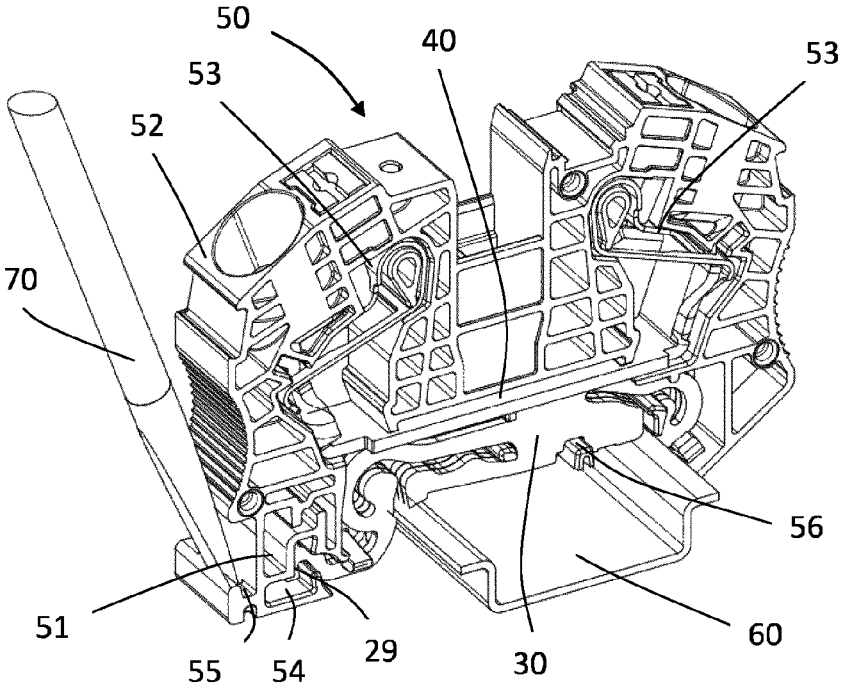
FIG. 6 is a first schematic view of a series terminal according to the invention, having an arrangement as shown in FIG. 5 latched onto a mounting rail.
Figure 7:
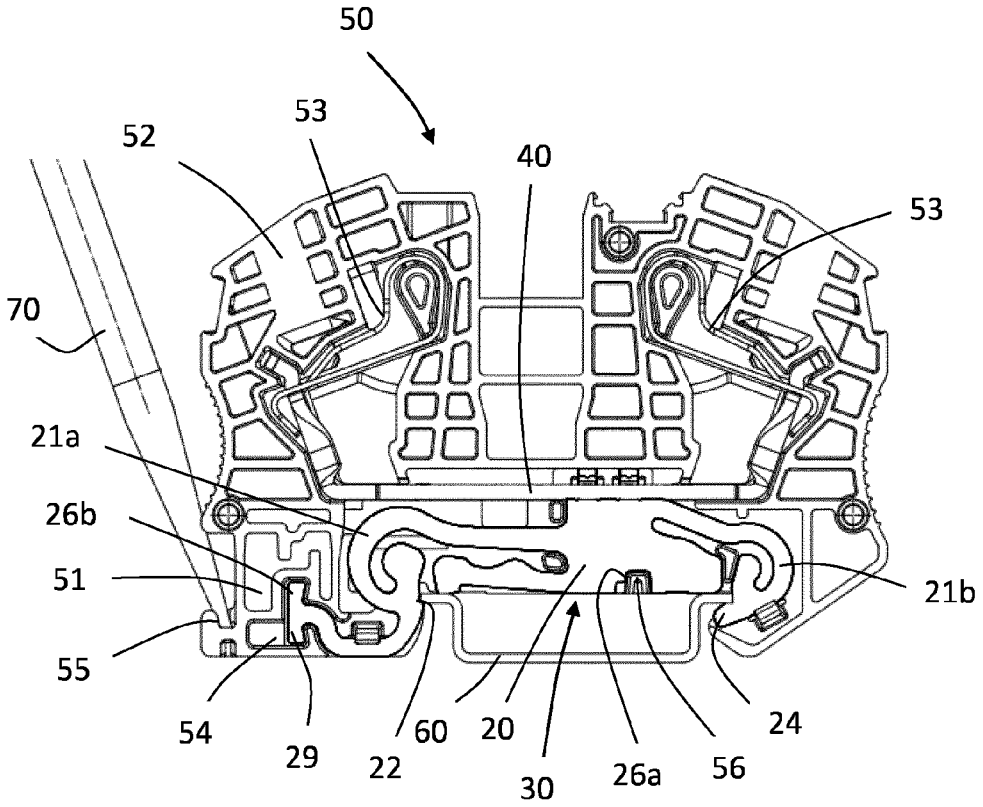
FIG. 7 is a further schematic view of the series terminal shown in FIG. 6.

In FIG. 1, a first metal foot 10 is shown, which is disc-shaped and has a first spring element 11*a* and a second spring element 11*b* which are formed on two opposite ends of the metal foot 10. The spring elements 11*a*, 11*b* are bent, substantially in a C shape. The first spring element 11*a* has a contact region 12 pointing towards the second spring element 11*b* for resting on a mounting rail 60 in a non-positive manner, as shown in FIGS. 6 and 7. The second spring element 11*b* has a securing region 13 pointing towards the first spring element 11*a* for positively securing the second spring element 11*b* to the busbar 60.

The contact region 12 of the first spring element 11*a* merely rests on the mounting rail 60 in a force-fit manner when the metal foot 10 is mounted on the mounting rail 60, as shown in FIGS. 6 and 7, such that the first spring element 11*a* of the metal foot 10 is not secured, in particular latched, to the mounting rail 60 by means of the contact region 12. The first spring element 11*a* is therefore not latched onto the mounting rail 60 in the state in which it is mounted on the mounting rail 60 and thus does not engage behind the mounting rail 60 either. In order to form a good contact surface, the contact region 12 of the first spring element 11*a* is rounded in the embodiment shown here.

The securing region 13 of the second spring element 11*b* has a latching surface or latch formed as an angled rear grip 14, which engages behind or under the bottom side the mounting rail 60 when the metal foot 10 is mounted on the mounting rail 60 such that the securing region 13 of the second spring element 11*b* of the first metal foot 10 can latch onto the mounting rail 60.

Furthermore, two resilient support legs 15*a*, 15*b* are formed between the two spring elements 11*a*, 11*b* and rest on the mounting rail 60 when the first metal foot 10 is mounted on the mounting rail 60.

Furthermore, a first assembly coding 16*a* is formed on the outer circumferential surface of the first metal foot 10, in the region between the two support legs 15*a*, 15*b*, in the form of a U-shaped recess. The first assembly coding 16*a* is formed on a bottom side 17 of the first metal foot 10 which points towards the mounting rail 60 in the mounted state.

Figure 5:
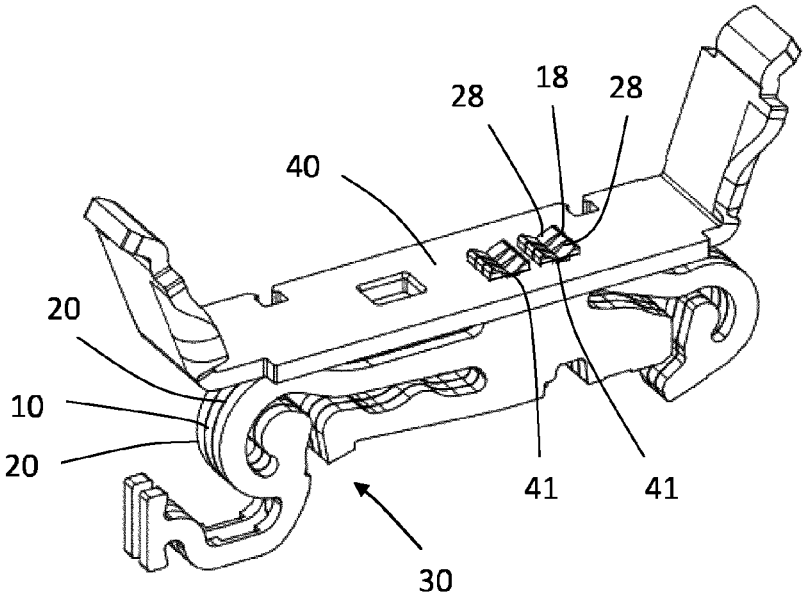
FIG. 5 is a schematic view of an arrangement of the metal foot arrangement shown in FIG. 3 on a busbar.

Furthermore, in order to mount the first metal foot 10 on a busbar 40, as shown by way of example in FIG. 5, the first metal foot 10 has two securing means 18 arranged next to one another, which are each in the form of a stud. The securing means 18 are integrally molded opposite the first assembly coding 16*a* on the outer circumferential surface of the first metal foot 10.

Figure 2:
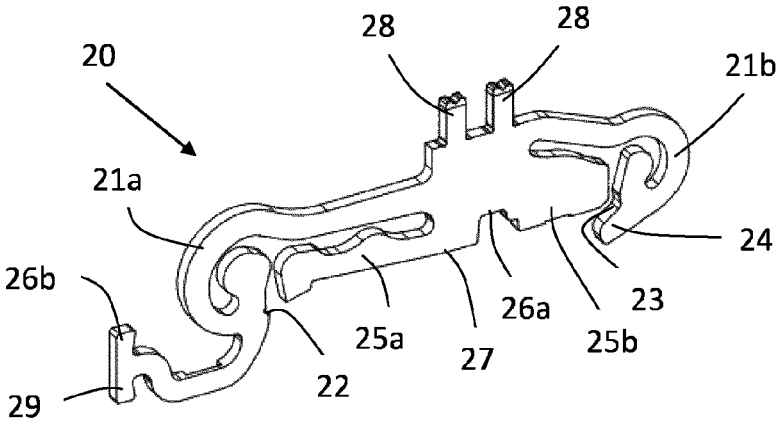
FIG. 2 is a schematic view of a second metal foot of a metal foot arrangement of a metal protective conductor connection element according to the invention.

In FIG. 2, a second disc-shaped metal foot 20 is shown, which likewise has a first spring element 21*a* and a second spring element 21*b*, which are formed at opposite ends of the second metal foot 20. Just as the two spring elements 11*a*, 11*b* of the first metal foot 10, the spring elements 21*a*, 21*b* of the second metal foot 20 are bent, in particular bent in a C shape.

The first spring element 21*a* of the second metal foot 20, however, differs from the first spring element 11*a* of the first metal foot 10 in that the first spring element 21*a* of the second metal foot 20 has a securing region 22, with which the first spring element 21*a* of the second metal foot 20 can latch in a positive manner onto the mounting rail 60 and can engage behind or under the mounting rail 60 when the second metal foot 20 is mounted on the mounting rail 60. In contrast to the first metal foot 10, in the case of the second metal foot 20, the first spring element 21*a* does not just rest on the mounting rail 60 when mounted on the mounting rail 60, but rather is also secured thereto in a positive manner such as by latching. The securing region 22 of the first spring element 21*a* of the second metal foot 20 has a latching surface, in particular a latch, for this purpose, which can engage behind or under the mounting rail in the mounted state.

Furthermore, in contrast to the first spring element 11*a* of the first metal foot 10, a latch element 29, which is formed as an extension of the first spring element 21*a* of the second metal foot 20, is integrally molded on the first spring element 21*a* of the second metal foot 20. The latch element 29 is hook-shaped and can latch into a foot element 51 of the series terminal 50 in a state in which it is mounted on a terminal housing 52 of a series terminal 50, as shown in FIGS. 6 and 7.

The second spring element 21*b* of the second metal foot 20 is essentially identical to the second spring element 11*b* of the first metal foot 10 and has a securing region 23 having a latching surface or latch designed as a rear grip 24, by means of which the second spring element 21*b* of the second metal foot 20 can be secured in a positive manner to the mounting rail 60 by latching or by engaging under or behind the mounting rail 60.

Furthermore, just as with the first metal foot 10, two resilient support legs 25*a*, 25*b* are formed between the two spring elements 21*a*, 21*b* of the second metal foot 20, which legs rest on the mounting rail 60 when the second metal foot 20 is mounted on the mounting rail 60.

Furthermore, a first assembly coding 26*a* provided in the form of a U-shaped recess is formed on the outer circumferential surface of the second metal foot 20, in the region between the two support legs 25*a*, 25*b*. The first assembly coding 26*a* is formed on a bottom side 27 of the second metal foot 20 which points towards the mounting rail 60 when in the mounted state. The contour of the first assembly coding 26*a* of the second metal foot 20 shown in FIG. 2 is slightly modified relative to that of the first assembly coding 16*a* of the first metal foot 10 shown in FIG. 1 such that, using this first assembly coding 16*a*, 26*a* of the first metal foot 10 and of the second metal foot 20, a mounting device can differentiate these two feet from one another, and therefore said feet can be arranged in an automated manner by a mounting device in the desired sequence in a metal foot arrangement 30, as is shown in FIGS. 3 and 4 for example.

In addition to the first assembly coding 26*a*, the second metal foot 20 comprises, in contrast to the first metal foot 10, a second assembly coding 26*b*, the second assembly coding 26*b* being hook-shaped and being integrally molded on the latch element 29 such that the second assembly coding 26*b*, together with the latch element 29, substantially form a T shape.

In order to secure the second metal foot 20 to a busbar 40, the second metal foot 20, just as the first metal foot 10, has two stud-shaped securing means 28 arranged next to one another.

Figure 3:
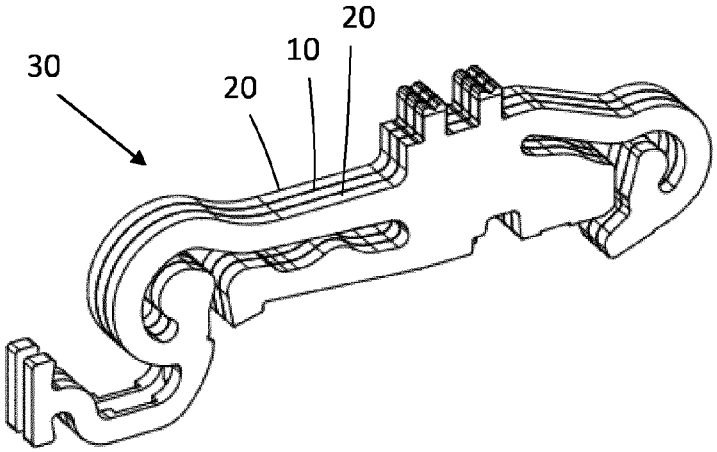
FIG. 3 is a schematic view of a metal foot arrangement according to one embodiment of the invention.
Figure 4:
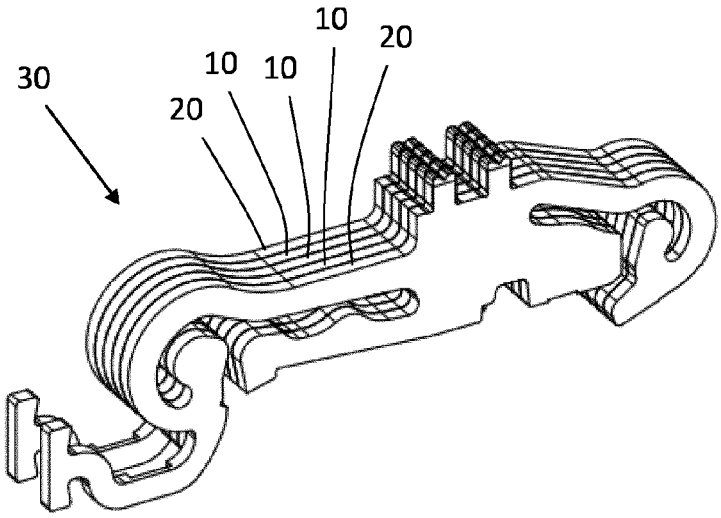
FIG. 4 is a schematic view of a metal foot arrangement according to a further embodiment of the invention.

In FIG. 3, a possible embodiment of a metal foot arrangement 30 is shown, the metal foot arrangement 30 shown in FIG. 3 having a first metal foot 10, as shown in FIG. 1, and two second metal feet 20, as shown in FIG. 2. In the process, the first metal foot 10 is arranged between the two second metal feet 20.

In FIG. 4, a further possible embodiment of a metal foot arrangement 30 is shown, the metal foot arrangement 30 shown in FIG. 4 having three first metal feet 10, as shown in FIG. 1, and two second metal feet 20, as shown in FIG. 2. In this case, the three first metal feet 10 are arranged between the two second metal feet 20.

FIG. 5 shows an arrangement in which the metal foot arrangement 30 shown in FIG. 3 is secured to a busbar 40. To this end, the busbar 40 has two elongate openings 41 arranged in parallel with one another, through which the securing means 18, 28 of the metal feet 10, 20 are passed and riveted to the busbar 40.

FIGS. 6 and 7 show a series terminal 50, which has a protective conductor connector element having a metal foot arrangement 30 as shown in FIG. 3, by means of which the series terminal 50 is latched onto the mounting rail 60 such that state in which a protective conductor connector element is mounted on a mounting rail 60 and a state in which a protective conductor connector element is mounted in a series terminal 50 is shown in FIGS. 6 and 7, respectively.

The series terminal 50, also referred to as a protective conductor terminal, has a terminal housing 52 made of an insulating material, two conductor connector elements 53 and one busbar 40 which electrically connects the conductor connector elements 53. The terminal housing 52 has a foot element 51, a receiving space 54 being formed inside the foot element 51, in which receiving space the latch element 29 and also the second assembly coding 26*b* of the second metal foot 20, which coding is formed on the latch element 29, are received in the mounted state, as shown in FIGS. 6 and 7. On an external side of the foot element 51, a handling socket 55 is formed, into which a release tool 70, for example the tip of a screwdriver as shown in FIG. 7, can be inserted in order to tilt the foot element 51 and therefore also the second metal foot 20, of the metal foot arrangement 30, which is locked with the latch element 29 and the second assembly coding 26*b* in the receiving space 54 of the foot element 51, such that the entire series terminal 50 can be removed from the mounting rail 60. Because only the one or more second metal feet 20 and not the one or more first metal feet 10 of the metal foot arrangement 30 are latched into the foot element 51 in the mounted state, an unlatching force also only has to be applied for the second metal feet 20 of the metal foot arrangement 30 and therefore not for the first metal feet 10 of the metal foot arrangement 30 by means of the release tool 70 and the handling socket 55.

As is also shown in FIGS. 6 and 7, the first assembly coding 16*a*, 26*a* of the first and second metal feet 10, 20 of the metal foot arrangement 30 are hooked into a counter-coding 56 formed on the terminal housing 52 of the series terminal 50.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

LIST OF REFERENCE NUMERALS

First metal foot 10
First spring element of the first metal foot 11*a*
Second spring element of the first metal foot 11*b*
Contact region 12
Securing region 13
Rear grip 14
Support leg 15*a*, 15*b*
First assembly coding of the first metal foot 16*a*
Bottom side 17
Securing means 18
Second metal foot 20
First spring element of the second metal foot 21*a*
Second spring element of the second metal foot 21*b*
Securing region 22
Securing region 23
Rear grip 24
Support leg 25*a*, 25*b*
First assembly coding of the second metal foot 26*a*
Second assembly coding of the second metal foot 26*b*
Bottom side 27
Securing means 28
Latch element 29
Metal foot arrangement 30
Busbar 40
Opening 41
Series terminal 50
Foot element 51
Terminal housing 52
Conductor connection element 53
Receiving space 54
Handling socket 55
Counter-coding 56
Mounting rail 60
Release tool 70

The invention claimed is:

1. An electrical series terminal arrangement comprising:

a mounting rail, wherein the mounting rail extends in a longitudinal direction and includes a first lip and a second lip extending in opposite directions from each other transversely to the longitudinal direction; and a metal protective conductor connection element for arrangement on an electrical series terminal, the metal protective conductor connection element having a metal foot arrangement including a first metal foot configured to rest on the mounting rail and a second metal foot configured to rest on the mounting rail, wherein the first metal foot includes a first spring element including a contact region configured to non-positively connect the first spring element of the first metal foot to the mounting rail, wherein the contact region of the first spring element is free of any latching surface capable of engaging under the second lip of the mounting rail so as to provide a non-positive connection of the contact region of the first spring element to the mounting rail, wherein the first metal foot includes a second spring element including a securing region configured to positively connect the second spring element of the first metal foot to the mounting rail, wherein the securing region of the second spring element includes a latching surface configured to engage under the first lip of the mounting rail so as to provide a positive connection of the second spring element to the mounting rail, wherein the second metal foot includes a further first spring element including a securing region configured to positively connect the further first spring element to the mounting rail, and wherein the second metal foot includes a further second spring element configured to positively connect the further second spring element to the mounting rail.

2. The terminal arrangement of claim 1, wherein the second metal foot further includes a latch element configured to latch onto a foot element of the terminal housing, such that when the metal protective conductor connection element is mounted on the series terminal, only the second metal foot of the metal foot arrangement is latched into the foot element of the terminal housing.

3. The terminal arrangement of claim 1, wherein the metal foot arrangement includes two second metal feet and at least one first metal foot, wherein the at least one first metal foot is arranged between the two second metal feet.

4. The terminal arrangement of claim 1, wherein the first metal foot and the second metal foot include an assembly coding.

5. The terminal arrangement of claim 4, wherein the assembly coding is formed on an outer circumferential surface of the first metal foot and/or on an outer circumferential surface of the second metal foot.

6. The terminal arrangement of claim 4, wherein a first assembly coding is formed on a bottom side of the first metal foot, wherein the bottom side points towards the mounting rail when the metal protective conductor connection element is mounted on the mounting rail.

7. The terminal arrangement of claim 6, wherein the first assembly coding is in a form of a recess.

8. The terminal arrangement of claim 4, wherein a second assembly coding is formed on a latch element of the further first spring element.

9. The terminal arrangement of claim 8, wherein the second assembly coding is in a form of a hook.

10. The terminal arrangement of claim 1, wherein the first metal foot and/or the second metal foot includes a securing unit configured to secure the metal foot arrangement to a busbar arranged inside the terminal housing.

11. The terminal arrangement of claim 1 comprising:

a terminal housing including an insulating material;

a first conductor connection element;

a second conductor connection element;

a busbar which electrically connects the conductor connection elements and arranged inside the terminal housing; and the terminal arrangement being configured to provide an electrically conductive connection between the busbar and the mounting rail.

12. The terminal arrangement of claim 4, wherein a first assembly coding is formed on a bottom side of the second metal foot, wherein the bottom side points towards the mounting rail when the connection element is mounted on the mounting rail.

13. The terminal arrangement of claim 4, wherein a first assembly coding is formed on a bottom side of the first metal foot, wherein the bottom side points towards the mounting rail when the connection element is mounted on the mounting rail, and wherein the first assembly coding is formed on a bottom side of the second metal foot, wherein the bottom side points towards the mounting rail when the connection element is mounted on the mounting rail.

* * * * *